US005205414A

United States Patent [19]

Martinez

[11] Patent Number: 5,205,414

[45] Date of Patent: Apr. 27, 1993

[54] PROCESS FOR IMPROVING THE CONCENTRATION OF NON-MAGNETIC HIGH SPECIFIC GRAVITY MINERALS

[76] Inventor: Edward Martinez, 13 Bayswater Pl., Chapel Hill, N.C. 27514

[21] Appl. No.: 716,068

[22] Filed: Jun. 17, 1991

[51] Int. Cl.[5] ..... B03C 1/00

[52] U.S. Cl. ..... 209/8; 209/214; 209/39

[58] Field of Search ..... 209/3, 8, 39, 40, 214, 209/223.1, 232, 458, 459, 460, 478, 636; 44/608, 620, 627

[56] References Cited

U.S. PATENT DOCUMENTS

| | | | |
|---|---|---|---|
| 3,926,789 | 12/1975 | Shubert | 209/8 |
| 3,938,966 | 2/1976 | Kindig et al. | 209/8 |
| 4,298,169 | 11/1981 | Iwasaki | 209/8 X |
| 4,565,624 | 1/1986 | Martinez | 209/40 |
| 4,643,822 | 2/1987 | Parsonage | 209/39 X |
| 4,659,457 | 4/1987 | Martinez | 209/40 |
| 4,735,707 | 4/1988 | Bustamante | 209/8 X |
| 4,765,486 | 4/1988 | Berlage et al. | 209/8 |
| 4,795,037 | 1/1989 | Rich, Jr. | 209/39 X |
| 4,802,976 | 2/1989 | Miller | 209/39 X |
| 4,902,428 | 2/1990 | Cohen | 209/214 X |
| 5,106,486 | 4/1992 | Hettinger | 209/8 X |

OTHER PUBLICATIONS

Mineral Deposits Limited Introduces the Gemeni Gold Table, Promotional brochure of Mineral Deposits Limited, undated.

Magnetic Spiral Test Results with a High Grade Heavy Mineral Sand Sample, Martinez, E., Feb. 1991.

Recovery of Magnetic and Weakly Magnetic Minerals by Gravity-Magnetic Separation, Martinez, E., Oct., 1990.

U.S. patent application filed Nov. 1990—"Improvements in Gravity Separators Having Metallic Troughs, Particularly Humphreys Spirals".

"Reichart Spiral Concentrator-Economical Wet Gravity Separation of Minerals". Promotional Brochure.

"Permanent Magnetic Wet Drum Separators," Product Brochure, Eriez Magnetics 1977.

*Primary Examiner*—Robert P. Olszewski
*Assistant Examiner*—James R. Bidwell
*Attorney, Agent, or Firm*—Steven J. Hultquist

[57] ABSTRACT

A process for improving the concentration of non-magnetic heavy minerals using a gravity-magnetic type separator, by the addition of a magnetic mineral or phase, such as magnetite, ilmenite, or iron filings, to the feed slurry. The addition of the magnetic material prior to feeding the gravity-magnetic separator results in an increase in the recovery of the non-magnetic heavy minerals in the feed, such as rutile, zircon, gold, tin, tungsten, etc.

30 Claims, 4 Drawing Sheets

PROCESS FOR IMPROVING THE CONCENTRATION OF NON-MAGNETIC HIGH SPECIFIC GRAVITY MINERALS

BACKGROUND OF THE INVENTION

1. Field of the Invention

This invention relates to a process for increasing the recovery of non-magnetic heavy minerals from lower specific gravity non-magnetic minerals, in materials such as ores, heavy mineral sands, tailings, and residues.

2. Description of the Related Art

In conventional gravity separators, differences in the specific gravities of the different individual minerals or phases making up the feed mixture are used to accomplish the separation of high specific gravity minerals from the low specific gravity minerals or phases. A wide variety of separator types has been used in such separation operations including spirals, Reichert cones, sluices, shaking tables, and various other gravity separators.

In recent years it has been discovered that conventional gravity separators can be modified by the addition of magnets to improve the recovery of magnetic and weakly-magnetic minerals, as described in U.S. Pat. No. 4,565,624, issued Jan. 21, 1986 and U.S. Pat. No. 4,659,457, issued Apr. 21, 1987, both in the name of E. Martinez, and U.S. Patent application Ser. No. 07/798,037 in the name of E. Martinez, relating specifically to modification of cast-iron spirals.

It would be a significant advance in the art, and is an object of the present invention, to provide a process whereby the concentration of high specific gravity non-magnetic minerals or phases can be improved compared to that achievable by conventional gravity separation.

It is another object of the invention to provide a low-cost, environmentally safe process for improving the recovery of non-magnetic heavy minerals, such as rutile, zircon, tin, and gold.

It is another object of the present invention to provide a means for improving the gravity separation process for recovery of high specific gravity non-magnetic minerals or phases, such as rutile, zircon, gold, tin, etc., by means of a gravity-magnetic type separator.

These and other advantages will become apparent from the following more detailed description of the invention.

SUMMARY OF THE INVENTION

The present invention broadly relates to a process for increasing the recovery of non-magnetic heavy minerals from lower specific gravity non-magnetic minerals in material such as ores, heavy mineral sands, tailing, and residues.

The improved separation achieved by the invention results from the addition of a magnetic substance to the pulp feed (feed mixture of solids, together with water) prior to its separation with a gravity-magnetic type separator. The gravity-magnetic separator utilizes both gravity and magnetic forces to achieve separation capabilities in recovering magnetic and weakly-magnetic minerals in excess of that which can be achieved by conventional gravity separators alone. The present invention involves adding a magnetic material to feed materials, e.g. feed materials that do not contain naturally-occurring magnetic constituents, to thereby improve the concentration of non-magnetic values with a gravity-magnetic type separator. The added magnetic material, as for example ilmenite, magnetite, or iron filings, may suitably be removed from the gravity-magnetic separator concentrate by a conventional wet magnetic separator and then recirculated to the feed material.

The process of the invention may be employed in a wide variety of applications for concentration of non-magnetic heavy minerals utilizing gravity-magnetic separation. The concentrated non-magnetic heavy minerals may comprises the desired product, such as rutile, zircon, gold, tin, tungsten, etc. Alternatively, the concentrated non-magnetic heavy minerals may comprise the refuse or tailings minerals in a specific feed material.

Thus, the specific application of the invention may be widely varied as regards the feed material having processed, the non-magnetic (e.g., mineral) species being concentrated, and the magnetic or weakly magnetic material being added to the feed material. For example, the invention may be employed in the processing of iron ore to recover magnetite as wel as hematite, or in the treatment of heavy mineral sand ore containing rutile, zircon, and ilmenite to recover all three minerals.

In a particularly preferred embodiment, the process of the invention involves adding a magnetic phase, such as magnetite, ilmenite, or iron filings, to a slurry feed material prior to feeding the slurry material to a conventional gravity separator that has been retrofitted with magnets to make a gravity-magnetic separator, as taught by U.S. Pat. Nos. 4,565,624 and 4,659,457, whereby the addition of the magnetic material to the feed material increases the recoveries of the non-magnetic high specific gravity minerals or phases which are achieved with the gravity-magnetic separator.

Other applications, aspects, and embodiments of the invention will be more fully apparent from the ensuing disclosure and appended claims.

DETAILED DESCRIPTION OF THE INVENTION, AND PREFERRED EMBODIMENTS THEREOF

Figure 1:
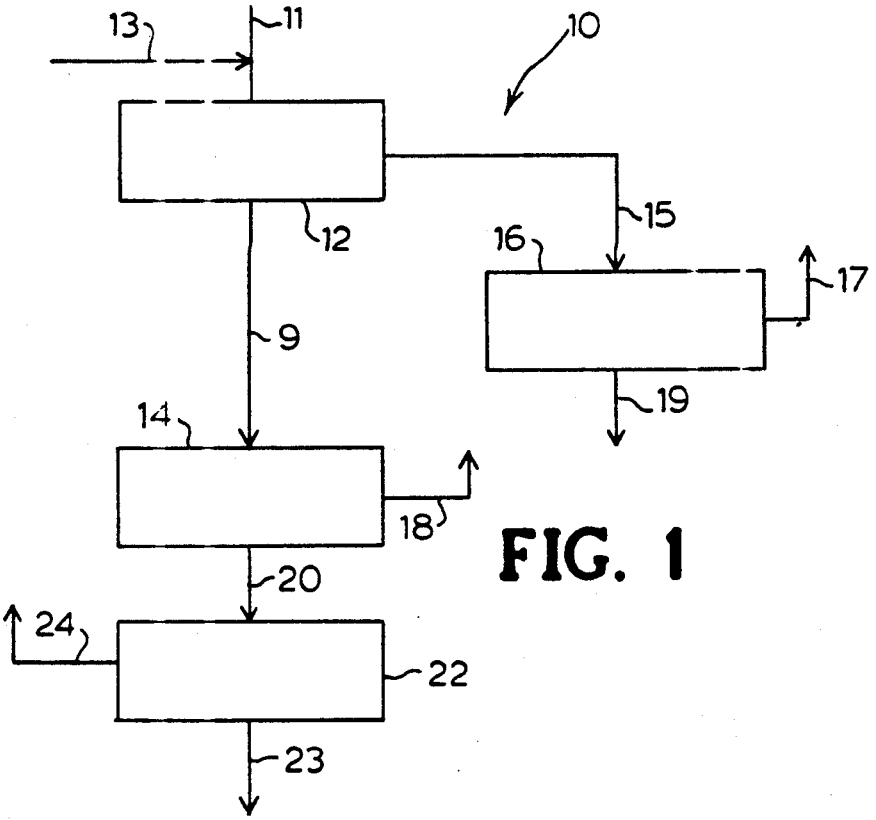
FIG. 1 is a schematic flow sheet of a process system according to one embodiment of the present invention.

The present invention is based on the surprising and unexpected discovery that the recovery of non-magnetic materials which typically are separated by gravity settling treatment, can be substantially increased by gravity-magnetic separation, utilizing magnetic or weakly magnetic materials as additives to the feed material itself.

Thus, it was found in testing spiral-type gravity separators which were retrofitted with magnets, that the recovery of the magnetic or weakly-magnetic minerals or phases was increased, compared to conventional gravity separation, as expected. However, it was surprisingly and unexpectedly found that in feed material containing other high specific gravity minerals or phases that are non-magnetic, the recovery of such non-magnetic minerals or phases was also increased.

For example, in processing iron ore, the recoveries of both magnetic magnetite as well as non-magnetic hematite were increased by the addition of magnets to the spiral to create a gravity-magnetic separator in accordance with the teachings of the aforementioned Martinez patents and pending U.S. application.

Similarly, in the treatment of a heavy mineral sand ore containing high specific gravity ilmenite, rutile, and zircon, by means of a spiral separator retrofitted with magnets, the recoveries of the non-magnetic rutile and zircon were increased along with that of the weakly-magnetic ilmenite. In other words, the presence of the naturally occurring weakly-magnetic ilmenite in the feed material caused an improved recovery of the non-magnetic minerals (rutile and zircon) by the gravity-magnetic separation.

The invention has numerous advantages, including:

(1) providing a procedure for improving the concentration of high specific gravity non-magnetic materials in ores, such as heavy mineral sands, tailings, or residues;

(2) providing a comparatively simple and inexpensive procedure for effecting such improved separation;

(3) permitting the exploitation of lower grade ores than would be possible in the absence of the invention;

(4) permitting the recovery of values currently lost in tailings of existing operations;

(5) providing an improved process for coal cleaning, involving reducing the ash and pyrite content of the coal, thereby decreasing environmental pollution from coal-burning plants; and (6) permitting the useful life of mines to be extended, by enhancing the efficiency of separation from otherwise sub-grade ores.

The invention in a preferred aspect relates to a process for recovering high specific gravity minerals from heavy mineral sands, or other feed materials, such as ores, tailings, or residues, utilizing a gravity-magnetic separation. The separation may utilize a magnet means for applying a magnetic attractive force which is co-directional with the force of gravity in the separator apparatus, as more fully disclosed and claimed in the aforementioned Martinez U.S. patents and pending application.

The separator apparatus employed in the practice of the present invention may be of any suitable type, as for example a conventional gravity separator which has been modified by installation or retrofitting of magnets to convert same to a gravity-magnetic separator. Examples of conventional gravity separators which may be thus modified include Wright concentrators, spiral separators, cones, sluices, pinched sluices, shaking tables, etc. A particularly preferred conventional gravity separator which may be thus modified is a Reichert spiral concentrator, commercially available from Mineral Deposits Limited (Golden, Colo.).

In a typical embodiment of the invention, a magnetic mineral or material is added to the slurry of feed material prior to feeding the slurry to a gravity-magnetic type separator. The magnetic material responds to the magnets mounted under the separating surface to the gravity separator and causes the non-magnetic high specific gravity minerals to move toward the concentrate side of the separator, thereby increasing the recovery of the non-magnetic mineral compared to the separation achieved by conventional gravity separation alone. The additives to the slurry could be in the form of minerals, such as magnetite or ilmenite. Alternatively, the additive could be in the form of magnetic elemental metal, e.g., iron filings.

Referring now to the drawings, FIG. 1 shows a schematic flow sheet of an illustrative process system 10 for carrying out the method of the present invention for recovery of values from an ore, in accordance with one embodiment of the invention.

The process system 10 comprises a rougher gravity-magnetic separator 12, to which is connected a pulp feed stream line 11, which in turn is connected in receiving relationship with magnetic material line 13.

The rougher gravity-magnetic separator 12 is joined via rougher concentrate line 9 to cleaner gravity-magnetic separator 14. The rougher gravity-magnetic separator 12 also is joined, by means of rougher tailings line 15, to scavenger gravity-magnetic separator 16.

The scavenger gravity-magnetic separator 16 in turn is connected joined to scavenger concentrate discharge line 17, and scavenger tailings discharge line 19.

Cleaner gravity-magnetic separator 14 is connected to cleaner tailings discharge line 18, and to cleaner concentrate discharge line 20. Cleaner concentrate discharge line 20 in turn feeds the wet drum magnetic separator 22, having associated therewith high specific gravity minerals final concentrate discharge line 23, and magnetic material recycle line 24.

In operation, a pulp feed stream of material containing a high specific gravity non-magnetic mineral, such as gold, tungsten, or tin, is introduced to the process system in pulp feed stream line 11, and has a magnetic material added thereto in line 13.

Separators 12, 14, and 16 are gravity-magnetic type separators for recovering the non-magnetic high specific gravity mineral from the pulp feed stream introduced to the process system in line 11, with respect to the various separations effected in these separators, as hereinafter described. Each of the gravity-magnetic type separators utilizes magnetic means, e.g., magnetic means of the type described hereinafter in connection with FIGS. 4 and 6, for the purpose of applying a magnetic attractive force which is co-directional with the force of gravity. It will be appreciated that the separators 12, 14, and 16 may be of any conventional gravity separator type, as modified by the addition thereto of magnet means, in accordance with the teachings of the aforementioned Martinez patents and applications. Thus, the separators may be magnet-retrofitted gravity separators, such as spirals, shaking tables, cones, or other type gravity separators as hereinabove illustratively mentioned.

A rougher tailings stream is discharged from separator 12 in line 15. This rougher tailings stream comprises predominantly low specific gravity particles; this stream may be transferred to a scavenger separator 16 as shown, for further processing, or alternatively it may be passed to a tailings pond (not shown). The scavenger tailings, representing the final tailings from the process system, are discharged from separator 16 from the scavenger gravity-magnetic separator 16 in line 19. The scavenger concentrate is discharged from separator 16 in line 17, from which it may be recycled to the rougher gravity-magnetic separator 12, via flow into pulp feed stream line 11.

The rougher concentrate produced by the rougher gravity-magnetic separator 12 is discharged from such separator in line 9, and is comprised largely of high specific gravity minerals, including the magnetic additive which was introduced in magnetic materials supply line 13. From line 9, the rougher concentrate is fed to cleaner gravity-magnetic separator 14, wherein it is separated to yield cleaner concentrate, discharged in line 20, and cleaner tailings, discharged in line 18.

The cleaner concentrate from separator 14 is fed to wet drum magnetic separator 22, which may be of a conventional type, such as the wet drum separator devices commercially available from Eriez Magnetics (Erie, Pa.), Stearns Magnetics (Cudahy, Wis.), or Sala International AB (Sala, Sweden). The magnetic separator 22 may be of a permanent type or an electromagnetic type, and can be of a concurrent or else a countercurrent type. In the magnetic separator 22, the cleaner concentrate is separated to produce a final concentrate of high specific gravity minerals, which is discharged in line 23, and a magnetic material stream, discharged in line 24, which may be recycled to magnetic material feed line 13, so that the recovered magnetic material is combined with the feed slurry in line 11.

The features and advantages of the present invention are more fully illustrated by the following non-limiting examples, wherein all parts and percentages are by weight, unless otherwise expressly stated. These examples illustrate the increased recovery of non-magnetic high specific gravity minerals when there is a magnetic mineral or phase present in the feed material, and illustrates the advantages and benefits achievable by the present invention. In the broad practice of the present invention, an added or supplemental magnetic material is added to a pulp, slurry, or other feed material which does not contain significant native magnetic or weakly magnetic material.

While any of various suitable types of gravity separating equipment may be modified with magnets to form a gravity-magnetic separator useful in the broad practice of the present invention, spirals are frequently highly preferred, e.g., cast-iron Humphreys-type spirals. Another type of gravity separator which may be usefully retrofitted with magnets to form a gravity-magnetic separator is a Gemini table.

The magnetic material added to the feed mixture in the broad practice of the present invention may be any suitable magnetic type material, preferably one having a high magnetic susceptibility. Illustrative of useful materials are magnetite, pseudo-rutile type mineral materials such as ilmenite or leucoxene, and iron filings. The added magnetic material may be utilized in any quantity relative to the feed mixture and processing rate as will produce a desirable enhanced recovery of non-magnetic high specific gravity constituents of the feed material, as compared to corresponding gravity separation alone. Thus, while any suitable amount of added magnetic material may be utilized, generally the amount of magnetic material added to the feed mixture will be from about 0.5 to about 25% by weight, based on the feed mixture (dry basis). Accordingly, the amount of the magnetic material may be between 0.5 and 5% by weight of the feed mixture, between 5 and 10% by weight, or between 10 and 25% by weight, on the same feed mixture dry weight basis, depending on the type of feed material being processed, the gravity-magnetic separator employed, the processing rate, and the quality of the separation to be carried out.

The magnets which may be employed to retrofit an existing gravity separator may be of any suitable type, but preferably are selected from magnets of the group consisting of neodymium-boron-iron types, samarium-cobalt types, and ferrite types.

In the ensuing Examples, Examples I and II describe process systems in which the feed contains native magnetic material, and Example II describes a process system in which externally supplied magnetic material is added to the feed.

EXAMPLE I

Figure 2:
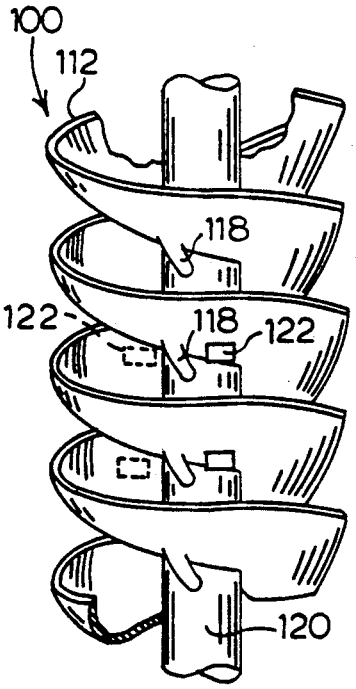
FIG. 2 is a partial perspective, partial section view illustrating a spiral separator modified with magnet means, such as may be used in the broad practice of the present invention.
Figure 4:
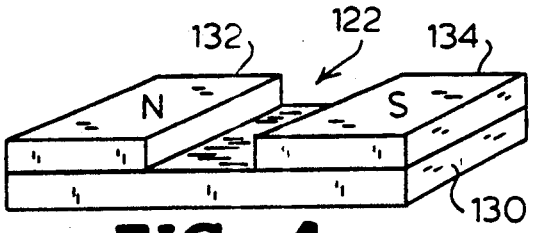
FIG. 4 is a perspective view of a magnet assembly, with which a gravity separator apparatus may be modified to yield a magnetic-gravity separator suitable for use in the practice of the present invention.
Figure 3:
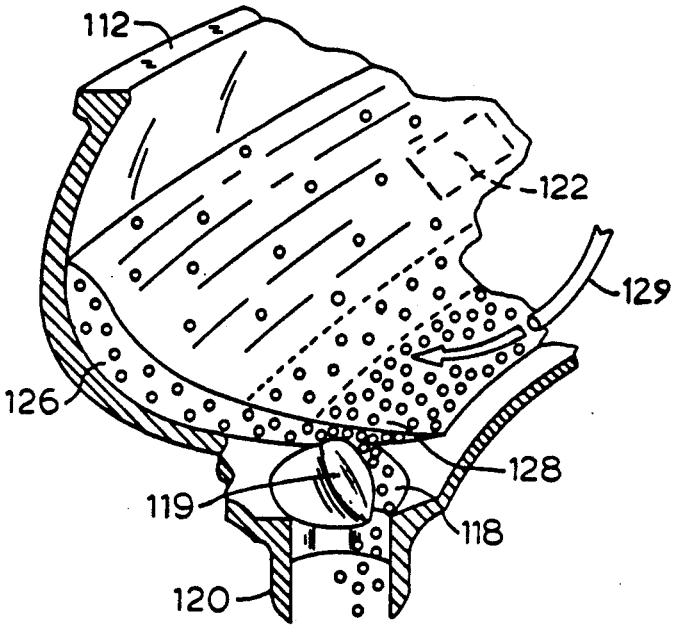
FIG. 3 is a partial perspective, partial section view of a portion of the FIG. 2 apparatus, showing the details of same in operation.

This example refers to iron ore separation, and has reference to the separation apparatus, portions of which are shown in FIGS. 2–4. FIG. 2 is a partial perspective, partial section view illustrating a spiral separator 100 modified with magnet means 122 of the type shown in FIG. 4. FIG. 3 is a partial perspective, partial sectioned view of a portion of the FIG. 2 apparatus, showing the details of same in operation.

Referring now to FIGS. 2–4, in the system utilized in carrying out the separation of this Example, 12 magnet means 122 were placed along each of the last two turns of the spiral 100, with each turn representing one 360° revolution of the trough 112. Two magnet means 122 were placed between each of the last seven ports 118 closest to the discharge end of the spiral 100.

Referring to FIG. 4, the magnetic means 122 used in this Example were inexpensive ferrite magnets. Each magnet means 122 comprised two permanent magnets 132, 134, each of which had dimensions of 1 inch×2 inch×⅜ inch (thickness), joined to one another by a plate 130 of mild steel construction, with the space between the two permanent magnets being approximately ½ inch.

Referring now to FIG. 3, as is known in the art of gravity separation, the heavier fraction 128 of the feed material tends to collect at the bottom of the trough 112 nearest the axis of the separator 100 where port 118 fitted with cutter 119 serves to remove the concentrate. The lighter materials 126 tend to collect near the top of the trough 112 for ultimate exit to the tailings. The materials discharged through port 118 are collected by cylindrical pipe 120 positioned along the axis of the spiral separator 100.

A drum of iron ore from the Labrador Trough in Canada, containing approximately 44% iron, was processed in a Mineral Deposit Limited Mark 6 spiral separator of a type as shown in FIGS. 2 and 3, equipped with ports and supplied with wash water (via conduit 129) to process the iron ore sample. The iron ore material was fed to the spiral separator, in the absence of retrofitted magnets, to determine the recovery and grade of the concentrate, without modification in the manner of the present invention. A second sample of the same ore then was fed, under similar conditions, to the spiral separator, after the separator had been retrofitted with 12 magnets, which were attached such that the magnetic field readings on the spiral separating surface were between 81 and 102 Gauss.

The tests were run at a feed rate of approximately two tons per hour, at 27.3% pulp solids (weight percentage of the ore in the pulp). The results are summarized in Table A below.

TABLE A

Iron and Magnetite Distributions In Products From Iron Ore Tests Run With A Mineral Deposit Limited MK- Spiral

| Product | % Wgt. | Analyses % $Fe^T$ | Analyses Magn. | % Distribution $Fe^T$ | % Distribution Magn. |
|---|---|---|---|---|---|
| | | Standard Spiral Test | | | |
| Conc. | 48.1 | 61.9 | 30.1 | 73.9 | 68.4 |
| Tails | 51.9 | 20.2 | 12.9 | 26.1 | 31.6 |
| | 100.0 | | | 100.0 | 100.0 |
| | | Spiral With Magnets | | | |
| Conc. | 61.3 | 62.9 | 30.1 | 87.7 | 85.2 |
| Tails | 38.7 | 13.9 | 8.3 | 12.3 | 14.8 |
| | 100.0 | | | 100.0 | 100.0 |

In the above table, "% Wgt." is the weight percentage of concentrate recovered via the ports 118 and the tailings; "$Fe^T$" refers to the weight percentage of the iron in the concentrate and tailings. "Magn." refers to the weight percentage of magnetite in the concentrate and tailings.

The data show clearly the improvement in the concentration of iron by modification of the spiral separator 100 with the addition of magnet means 122. The iron recovery was increased from 73.9% to 87.7% (about 18% relative). The products from these tests were run on a Davis tube and a Satmagan (Saturation Magnetic Analyzer) to determine magnetite contents. The results demonstrate that the magnetite assays of both concentrates were the same, but the magnetite recovery with the magnets was increased from 68.4% to 85.2% with the spiral retrofitted with magnets.

The iron in Labrador Trough ore is present as both magnetite and specular hematite. With the total iron and magnetite assays it is possible to calculate the hematite content. The results are given in Table B below and show that the addition of magnets increased the hematite recovery from 76.5% to 89.1% in the rougher gravity circuit. Hematite would not be recovered by conventional magnetic separators in a scavenger circuit often used in ore processing plants.

TABLE B

Hematite Distributions In Products From Iron Ore Tests Run With A Mineral Deposit Limited MK-6 Spiral

| Product | % Wgt. | % Hem. | % Dist. |
|---|---|---|---|
| | Standard Spiral Test | | |
| Conc. | 48.1 | 57.3 | 76.5 |
| Tails | 51.9 | 16.3 | 23.5 |
| | 100.0 | | 100.0 |
| | Spiral With Magnets | | |
| Conc. | 61.3 | 58.3 | 89.1 |
| Tails | 38.7 | 11.3 | 10.9 |
| | 100.0 | | 100.0 |

In the above title "%Hem." refers to the percentage of the non-magnetic hematite in the concentrate and tailings.

The feed sample contained about 42% total iron present in approximately 21% magnetic magnetite and 38% non-magnetic hematite. The increased hematite recovery is a result of the magnetite present in the feed. The magnetite responds to the magnet means 22 placed underneath the separating surface of the spiral, causing the hematite particles to move to the inner or concentrate side of the spiral. From the results, shown in Tables A and B above, it is seen that the addition of magnet means 112 to the gravity separator invariably increased the recovery of the magnetic magnetite and the non-magnetic hematite.

EXAMPLE II

Figure 5:
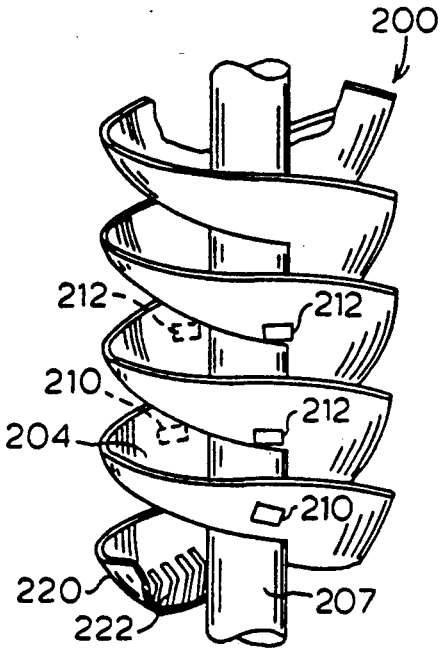
FIG. 5 is a perspective view of a spiral gravity-magnetic separator according to another embodiment, which may be usefully employed in the broad practice of the present invention.
Figure 6:
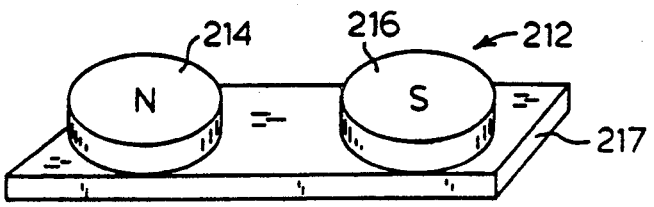
FIG. 6 is a perspective view of a magnet assembly, such as may be utilized in the gravity-magnetic separator illustratively shown in FIGS. 2 and 5.

This Example involves the separation of heavy mineral sand, utilizing a gravity-magnetic separator 200 as shown in FIG. 5, which was retrofitted by installation therein of magnetic means 122 of the type shown in FIG. 4, and magnetic means 212 of the type shown in FIG. 6, relative to the corresponding gravity separator.

A heavy mineral sand sample was tested containing approximately 13% heavy mineral consisting of weakly-magnetic ilmenite and non-magnetic rutile and zircon. Other high specific gravity minerals present were staurolite, kyanite, and sillimanite. Eleven tests were run at a mill site with a Mineral Deposit Limited MG 4 spiral.

Referring now to FIG. 5, the spiral separator 200 does not have ports to remove concentrate into the central cylindrical pipe 207, as in the case of the spiral separator 100 in Example I. In the FIG. 5 separator, splitters 222 at the discharge end 220 of the spiral separator split the discharge into seven fractions. The concentrate consisting of heavy minerals is in the fractions split closest to the interior side of the spiral separator 200 near the central cylindrical pipe 207.

Four magnet means 210 were placed in spaced relation along the last turn of the spiral separator 100. The magnet means 210 were made of neodymium-boron-iron and were similar to those described in connection with FIG. 4, except that each pole was 2-inch×2-inch ×½ inch thick. In addition, referring to FIG. 6, five magnet means 212 were spaced along the next-to-last turn of the separator 100. The magnet means 212 were made of neodymium-boron-iron but each North pole 214 and South pole 216 were ⅞-inch in diameter and ⅜-inch thick. The North pole 214 and South pole 216 of magnet means 212 were joined by a mild steel plate 217 which was ⅞-inch wide, 2-inches long and ¼-inch thick. The magnetic field strength on the separating surface 204 ranged from 1750 to 1910 Gauss for magnet means 210, and between 1610 and 1760 Gauss for the ⅞" disk magnet means 212.

The tests were run with different magnet means configurations and field strengths. In the tests, splitters 222 divided the discharge from the separator into seven fractions, from the concentrate side to the tailings side. Each fraction was subjected to a sink-float test using acetylene tetrabromide with a specific gravity of 2.96, and the weight percentage of the sink or heavy mineral content was determined.

Figure 7:
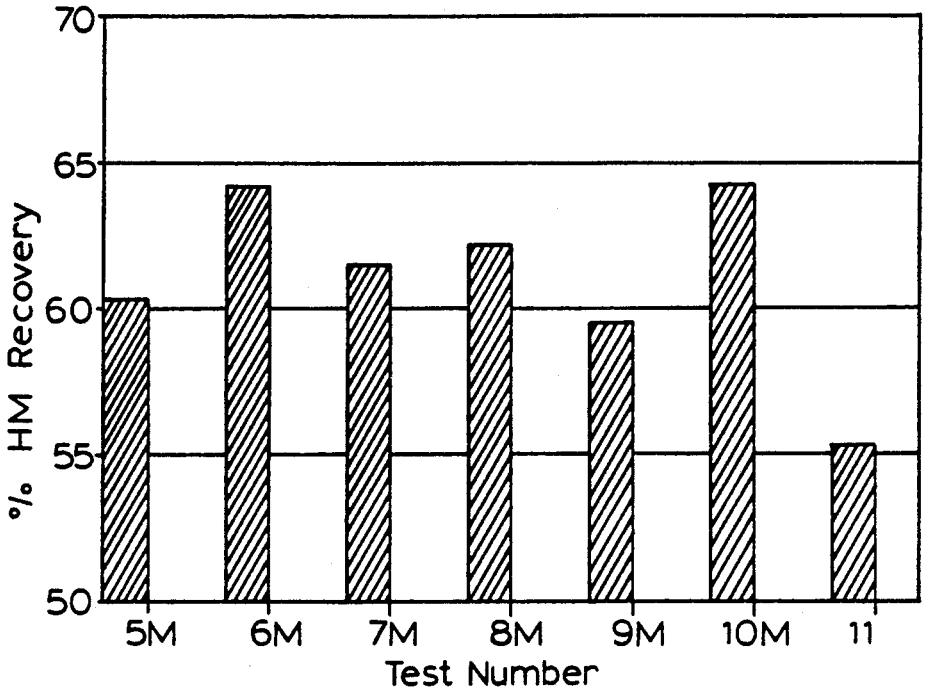
FIG. 7 is a graph showing percentage heavy mineral recovery, as a function of test number, wherein the test numbers suffixed with "M" denote tests with a gravity-magnetic separator.

FIG. 7 is a graph showing the heavy mineral contents in the first two concentrate fractions SP1+SP2 from the last six tests. The designation M after a test number in FIG. 7 indicates a test run with magnet means 210 and 212 added to the spiral. Optimum results were obtained in Test 10M with magnet means 210 and 212 in which the heavy mineral content of the concentrate was increased to 64.2% weight percentage of the feed, as compared to 55.5% in Test 11, run without magnet means. The 8.7% improvement in heavy mineral weight recovery was due not only to the increased recovery of weakly-magnetic ilmenite, but also to increased recoveries of the non-magnetic zircon and rutile. Every test in which the separator was retrofitted with magnet means 210 and 212 increased the heavy mineral recovery as compared to the control test.

Figure 8:
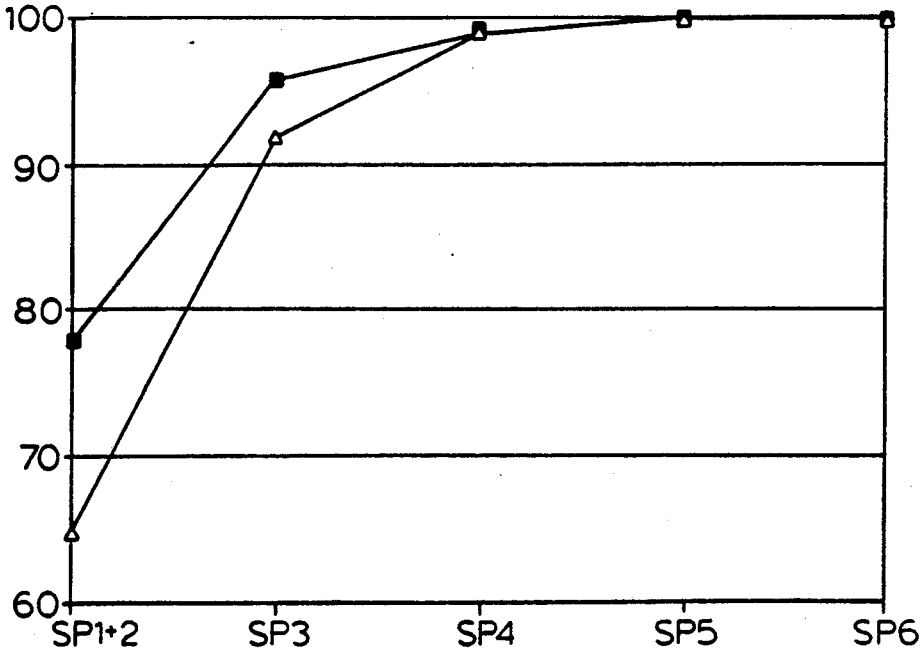
FIG. 8 is a graph of ilmenite recovery, as a function of splitter settings, for gravity-magnetic separation, and for gravity separation alone.
Figure 9:
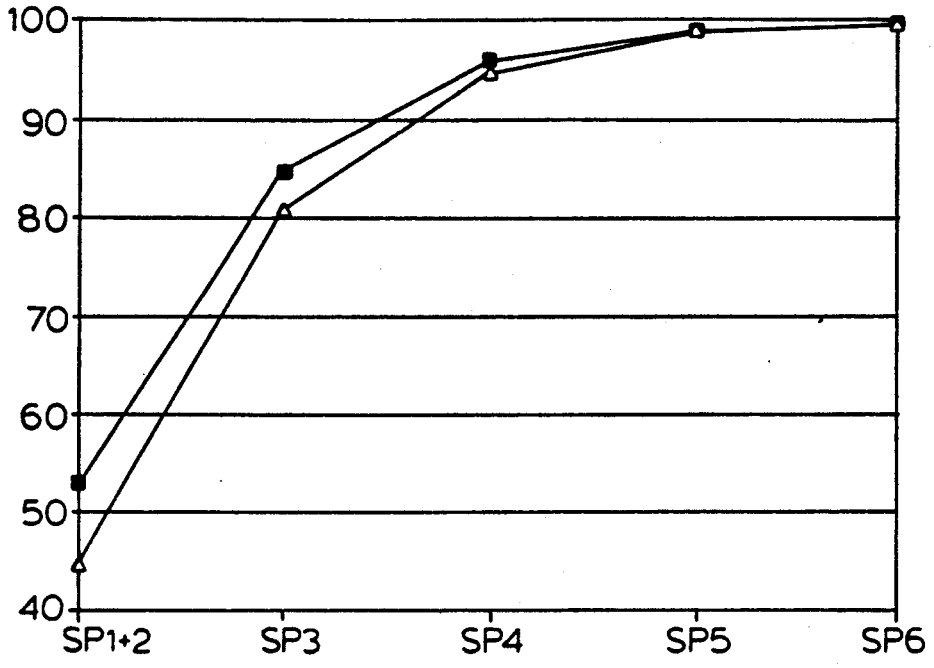
FIG. 9 is a graph of rutile recovery as a function of splitter settings, for a gravity-magnetic separation, and for gravity separation alone.
Figure 10:
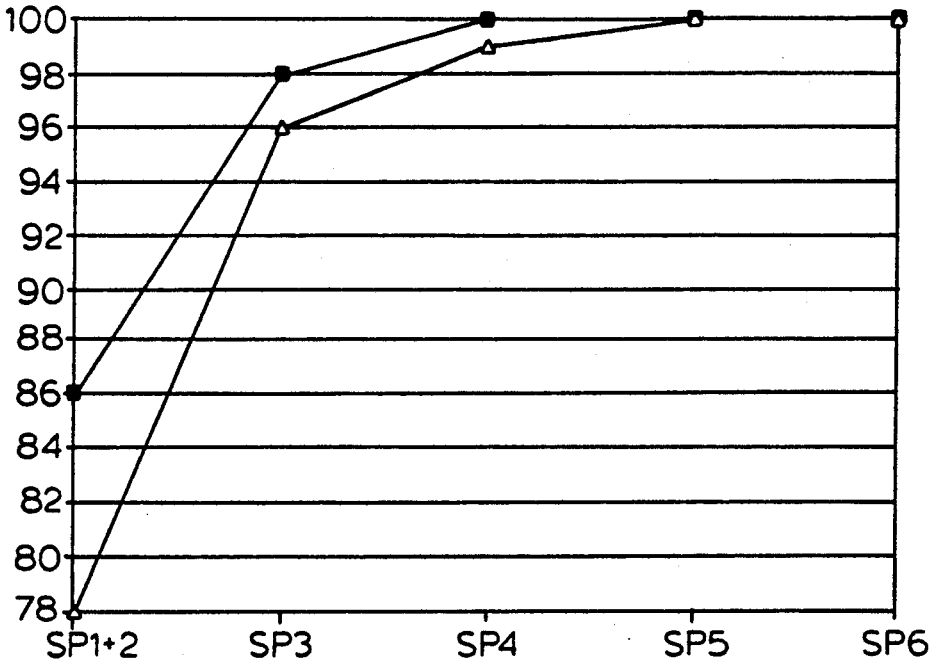
FIG. 10 is a graph of zircon recovery as a function of splitter settings, for gravity-magnetic separation, and for gravity separation alone.

The results from Test 11 (the control), and Test 10M were subjected to further heavy liquid separations using Clerici solution to determine the weight percentage of ilmenite, rutile, and zircon. Several recovery graphs for the heavy minerals, rutile, zircon, and ilmenite are presented in FIGS. 8 to 10, in which the curves based on the data points "Δ" represent the results of Test 11 (the control), while the curves based on the data points " ■ " represent the results of Test 10M. In these graphs the SP numbers refer to the fractions split from the discharge of the spiral separator. SP1+SP2 can be considered the concentrate and SP6+SP7 the tailings. SP3+SP4+SP5 are middlings that would be recycled to other separators in the mill flowsheet. The Y axis is the weight percentage of the ilmenite, rutile or zircon, as applicable, in each splitter fraction. Referring to FIGS. 8, 9, and 10, the data show that the retrofitting of the spiral separator with magnet means 210 and 212 improved the recoveries of both weakly-magnetic (ilmenite) and non-magnetic (rutile and zircon) values.

If fractions SP1+SP2 are considered the concentrate, the following summarizes the increase in recoveries and the weight percentage in the concentrates resulting from the addition of magnet means to the spiral separator:

| | HM % | Ilmenite % | Rutile % | Zircon % |
|---|---|---|---|---|
| | | % Recovery to Concentrate | | |
| Test 10M | 64.2 | 77.6 | 53.0 | 85.5 |
| Test 11 | 55.5 | 64.6 | 44.9 | 77.9 |
| | | % Concentrate Grade | | |
| Test 10M | 95.9 | 55.5 | 1.5 | 25.5 |
| Test 11 | 94.9 | 54.1 | 1.7 | 25.9 |

In the above tabulation, HM refers to the high specific gravity minerals. The recovery is the weight percentage of the feed material in the concentrate. Grade is the weight percentage of the heavy mineral (ilmenite, rutile, and zircon) in the SP1+SP2 concentrate.

The increased recoveries of non-magnetic rutile and zircon are the result of the weakly-magnetic ilmenite being present in the feed and responding to the magnets placed underneath the separating surface of the spiral.

It is to be understood that in the above-described illustrative Examples, the feed pulp contained naturally-occurring magnetic or weakly-magnetic minerals. The corresponding embodiments of the invention require that a magnetic mineral or phase be added to the feed pulps that do not contain naturally-occurring magnetic minerals or phases.

EXAMPLE III

A Mineral Deposit Mark 7A molded fiberglass spiral is fed with ground gold ore, in which the gold is associated with sulfides, at a rate of 2.053 metric tons per hour. The percentage of solids in the feed slurry is 37.3%.

The spiral concentrate assay is 89.0 grams per metric ton (2.60 ounces per short ton) of gold compared with a feed assay of 3.04 grams per metric ton (0.09 ounces per short ton) of gold. The concentrate, representing 2.6% by weight of the feed, contains 75.5% of the gold in the feed. The middlings product, represents 4.7% by weight of the feed, and contains 6.2% of the gold in the feed. The combined gold recovery in the concentrate and the middlings is 81.7% of the gold contained in the feed.

The addition of a magnetic material to the feed, and adding magnets to the spiral to make a gravity-magnetic separator, will increase the gold recovery compared to that obtained by the conventional spiral. In this gold recovery system, a wet drum magnetic separator is required to remove the magnetic material from the spiral concentrate and recirculate it to the spiral.

The present invention thus contemplates the addition of a magnetic material, such as a solid magnetic material comprising magnetite, ilmenite, iron filings, or other solid magnetic material, to a feed mixture comprising high specific gravity non-magnetic material and lower specific gravity non-magnetic material, thereby forming a magnetic material-augmented feed mixture. The augmented feed mixture then may be separated by gravity-magnetic separation to realize an enhanced recovery of the high specific gravity non-magnetic material, relative to recovery conducted in the absence of magnetic material being added to the feed mixture.

It will also be recognized that in some instances the feed material may contain some traces or even significant values of native magnetic material, and that such material may be augmented with additional magnetic material in accordance with the invention, to further increase its magnetic material content, and achieve an enhanced high specific gravity non-magnetic material recovery from the feed material.

It is to be understood that the foregoing embodiments and examples are intended to be illustrative only, and that numerous alternative embodiments of the invention may be followed by those skilled in the art, without departing from the scope and spirit of the claims that follow.

What is claimed is:

1. A solids separation process for separating high specific gravity non-magnetic solids material from a feed mixture also comprising non-magnetic solids material having a lower specific gravity than said high specific gravity non-magnetic solids material, for enhanced recovery of said high specific gravity non-magnetic solids material relative to the recovery obtained by gravity separation of the feed mixture, said process comprising the steps of:

(a) combining said feed mixture with a magnetic solids material to form a magnetic solids material-augmented feed mixture; and (b) separating the magnetic solids material-augmented feed mixture by gravity-magnetic separation to recover a concentrate comprising high specific gravity non-magnetic solids material and magnetic solids material, wherein the concentration of high specific gravity non-magnetic solids material in the concentrate is enhanced, relative to conventional gravity separation or gravity-magnetic separation of the feed mixture in the absence of the added magnetic solids material.

2. A process according to claim 1, further comprising:

(c) feeding the concentrate to a wet magnetic separator for removal of said magnetic solids material from the concentrate; and (d) recycling the recovered magnetic solids material from step (c) for combining with the feed mixture in step (a).

3. The process of the claim 1, wherein said gravity magnetic separation is carried out in a gravity separator retrofitted with magnets, wherein the gravity separator is of a type selected from the group consisting of spirals, sluices, pinched sluices, Reichart cones, and shaking tables.

4. A process according to claim 3, wherein the gravity separator is a cast-iron Humphreys type spiral.

5. A process according to claim 3, wherein the gravity separator is a Gemini table.

6. A process according to claim 1, wherein the magnetic solids material added to the feed mixture comprises magnetite.

7. A process according to claim 1, wherein the magnetic solids material added to the feed mixture comprises a pseudo-rutile type mineral comprising ilmenite or leucoxene.

8. A process according to claim 1, wherein the magnetic solids material added to the feed mixture comprises iron filings.

9. A process according to claim 1, wherein the amount of the magnetic solids material added to the feed mixture is between 0.5 and 5% of the feed mixture weight, on a dry solids basis.

10. A process according to claim 1, wherein the amount of the magnetic solids material added to the feed mixture is between 5 and 10% of the feed mixture weight, on a dry solids basis.

11. A process according to claim 1, wherein the amount of the magnetic solids material added to the feed mixture is between 10 and 25% of the feed mixture weight, on a dry solids basis.

12. A process according to claim 1, wherein the gravity-magnetic separation is carried out in a gravity-magnetic separator comprising magnets selected from the group consisting of: magnets of the neodymium-boron-iron type; magnets of the samarium-cobalt type; and ferrite magnets.

13. A process according to claim 1, wherein the feed mixture prior to step (a) is substantially devoid of magnetic material therein.

14. A process according to claim 1, wherein the gravity-magnetic separation comprising separating the augmented feed mixture on a generally downwardly sloping surface over which the augmented feed mixture flows under the influence of co-directional gravity and magnetic forces, and wherein the separation is carried out in such manner as to prevent the buildup of magnetic material on the separation surface.

15. A process according to claim 1, wherein the magnetic solids material is non-adherent to and non-absorbed by the high specific gravity non-magnetic solids material and the lower specific gravity non-magnetic solids material.

16. A process according to claim 1, wherein the feed mixture contains magnetic solids material therein prior to step (a) being carried out.

17. A process according to claim 1, wherein the high specific gravity non-magnetic solids material comprises a material selected from the group consisting of rutile, zircon, tin, gold, tungsten, and mixtures thereof.

18. A process according to claim 1, wherein the magnetic solids material comprises a material selected from the group consisting of ilmenite, magnetite, iron, leucoxene, and mixtures thereof.

19. A process for improving the removal of high specific gravity minerals such as pyrite or ash from a coal feed mixture, said process comprising the steps of:

(a) combining the coal feed mixture with a magnetic solids material to form a magnetic solids material-augmented feed mixture; and (b) separating the magnetic solids material-augmented feed mixture by gravity-magnetic separation to recover a product of reduced high specific gravity minerals content or refuse.

20. A process according to claim 19, further comprising:

(c) feeding the refuse produced by the gravity-magnetic separation to a wet magnetic separator for removal of magnetic solids material from the refuse; and (d) recycling the removed magnetic solids material from step (c) for combining with the coal feed mixture in step (a).

21. A process according to claim 19 wherein the gravity-magnetic separation is carried out in a gravity separator retrofitted with magnets, wherein the gravity separator is of a type selected from the group consisting of spirals, sluices, pinched sluices, Reichert cones, and shaking tables.

22. A process according to claim 19, wherein the magnetic solids material added to the coal feed mixture has a high magnetic susceptibility.

23. A process according to claim 19, wherein the magnetic solids material comprises a material selected from the group consisting of magnetite and iron filings.

24. A process according to claim 19, wherein the amount of magnetic solids material added to the coal feed mixture is between 0.5 and 5% by the weight of the coal feed mixture, on a dry basis.

25. A process according to claim 19, wherein the amount of magnetic solids material added to the coal feed mixture is between 5 and 10% of the weight of the coal feed mixture, on a dry basis.

26. A process according to claim 19, wherein the amount of magnetic solids material added to the coal feed mixture is between 10 and 25% of the weight of the coal feed mixture, on a dry basis.

27. A process according to claim 19, wherein the gravity-magnetic separation is carried out in a gravity-magnetic separator comprising magnets selected from the group consisting of: magnets of the neodymium-boron-iron type; magnets of the samarium-cobalt type; and ferrite magnets.

28. A solids separation process for separating high specific gravity non-magnetic solids material from a feed mixture also comprising non-magnetic solids material having a lower specific gravity than said high specific gravity non-magnetic solids material, for enhanced recovery of said high specific gravity non-magnetic solids material relative to the recovery obtained by gravity separation of the feed mixture, wherein said feed mixture is substantially free of magnetic solids material therein, said process comprising the steps of:

(a) combining said feed mixture with a magnetic solids material which is non-adherent to and non-absorbed by the high specific gravity non-magnetic solids material and the lower specific gravity non-magnetic solids material, to form a magnetic solids material-augmented feed mixture; and (b) separating the magnetic solids material-augmented feed mixture by gravity-magnetic separation to recover a concentrate comparing comprising high specific gravity non-magnetic solids material and magnetic solids material, wherein the concentration of high specific gravity non-magnetic solids material in the concentrate is enhanced, relative to conventional gravity separation or gravity-magnetic separation of the feed mixture in the absence of the added magnetic solids material, said gravity-magnetic separation comprising separating the magnetic solids material-augmented feed mixture on a generally downwardly sloping separation surface over which the magnetic solids material-augmented material flows under the influence of a directional magnetic force which is co-directional with the gravitational force acting on the magnetic solids material-augmented feed mixture on the separation surface, and wherein the separation is carried out in such manner as to prevent the buildup of magnetic material on the separation surface.

29. A process according to claim 28, wherein the high specific gravity non-magnetic solids material comprises a material selected from the group consisting of rutile, zircon, tin, gold, tungsten, and mixtures thereof.

30. A process according to claim 29, wherein the magnetic solids material comprises a material selected from the group consisting of ilmenite, magnetite, iron, leucoxene, and mixtures thereof.

* * * * *

UNITED STATES PATENT AND TRADEMARK OFFICE

CERTIFICATE OF CORRECTION

PATENT NO. : 5,205,414

DATED : April 27, 1993

INVENTOR(S) : Edward Martinez

It is certified that error appears in the above-identified patent and that said Letters Patent is hereby corrected as shown below:

Column 1, line 54, change "tailing" to --tailings--.

Column 2, line 21, change "wel" to --well--.

Column 13, line 21, after "concentrate" delete --comparing--.

Signed and Sealed this

Twelfth Day of April, 1994

Bruce Lehman

*Attest:*

BRUCE LEHMAN

*Commissioner of Patents and Trademarks*

*Attesting Officer*